US007433623B2

(12) United States Patent
Nakamura et al.

(10) Patent No.: US 7,433,623 B2
(45) Date of Patent: Oct. 7, 2008

(54) IMAGE FORMING APPARATUS WITH TWO RECORDING SHEET COOLING OUTLETS

(75) Inventors: Masakazu Nakamura, Hachioji (JP); Masami Maruko, Hachioji (JP); Kazunori Katada, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 245 days.

(21) Appl. No.: 11/148,745

(22) Filed: Jun. 9, 2005

(65) Prior Publication Data

US 2006/0133865 A1 Jun. 22, 2006

(30) Foreign Application Priority Data

Sep. 13, 2004 (JP) ..... 2004-265179
May 6, 2005 (JP) ..... 2005-135026

(51) Int. Cl.
*G03G 15/20* (2006.01)
*G03G 21/20* (2006.01)

(52) U.S. Cl. ..... 399/92; 399/107; 399/341

(58) Field of Classification Search ..... 399/92, 399/107, 110, 306, 309, 341, 401
See application file for complete search history.

(56) References Cited

U.S. PATENT DOCUMENTS 4,959,693 A * 9/1990 Mitsuya et al. ..... 399/401
5,218,411 A * 6/1993 Kosugiyama et al. ..... 399/341
6,271,870 B1 * 8/2001 Jacob et al.
2004/0091281 A1 * 5/2004 Kimizuka ..... 399/92

* cited by examiner

*Primary Examiner*—David M. Gray
*Assistant Examiner*—Laura K Roth
(74) *Attorney, Agent, or Firm*—Lucas & Mercanti, LLP

(57) ABSTRACT

The image forming apparatus cools the recording sheet with a cooling fan having an air duct with a first air-blowing outlet and a second air-blowing outlet for directing air from the cooling fan to an interior of the apparatus. An air flow changing member opens or closes the first and second air-blowing outlets, depending on the conveying path of the recording sheet.

8 Claims, 5 Drawing Sheets

IMAGE FORMING APPARATUS WITH TWO RECORDING SHEET COOLING OUTLETS

RELATED APPLICATION

This application is based on patent application(s) No(s). Patent Application 2005-265179 and 2005-135026 filed in Japan, the entire content of which is hereby incorporated by reference.

BACKGROUND

1. Field of the Invention

The present invention relates to an image forming apparatus, such as copier, printer, and facsimile, and specifically relates to an image forming apparatus which can print data on one side of the recording sheet and also can print data on both sides of the recording sheet by inverting the recording sheet.

2. Description of the Related Art

Most of recent image forming apparatus, such as copiers, printers, and facsimiles, can print image information not only on one side of the recording sheet (also referred to as transfer sheet or sheet) but also on both sides of the recording sheet by means of electrophotography.

In some cases, such an image forming apparatus includes, for example, a face-up paper discharging function for discharging paper with the printed surface face up and a face-down paper discharging function for discharging paper with the printed surface face down so that those functions can be selected and executed when discharging the printed recording sheet. Specifically, when image information is printed on one side of the recording sheet, thereby making it possible for the printing condition to be checked immediately.

Generally, in an electrophotographic image forming apparatus, an electrostatic latent image which has been formed on an image carrier based on the image information of a document is developed by toner to become a toner image, and then is transferred onto the recording sheet. The toner image which has been transferred on the recording sheet is heated and pressurized by the fixing unit to melt and fix onto the recording sheet, and then the recording sheet is discharged outside the apparatus.

The recording sheet which has just passed through the fixing unit is still hot, and in a conventional image forming apparatus, a cooling fan blows air to quickly cool the recording sheet. But in some cases, the paper is not cooled fast enough resulting in incomplete fixation of the toner that has been melted and transferred onto the recording sheet.

Specifically when the face-down paper discharging operation or the inverting and conveying operation is to be conducted, the printed surface of the recording sheet comes in contact with members, such as rollers, located along the conveying path, and a portion of the toner image that has not been completely solidified and fixed is sticky, causing the recording sheet to stick to the rollers or to be contaminated by friction. Also, a phenomenon called "uneven cooling" occurs because difference in toner fixation arises between the portion of the toner image that has been immediately cooled, solidified, and fixed by coming in contact with the rollers and the other portion of the toner image where the toner has been slowly solidified and fixed. As a result, image roughness due to partially insufficient fixation occurs. Specifically, when the image is a color image, color hues greatly differ, causing the quality of the color image to greatly deteriorate.

Therefore, a conventional technology has been disclosed (for example, Japanese application patent laid-open publication No. 09-22228) which has a first cooling unit for cooling the image forming surface of the recording sheet that has been conveyed from the image forming section by blowing air inside the apparatus and a second cooling unit for cooling the backside of the recording sheet by blowing outer air directed from the outside of the apparatus so that the recording sheet which has just passed through the fixing unit can be quickly cooled from above and below by the first cooling unit and the second cooling unit respectively thereby preventing uneven cooling.

However, in the technology disclosed in the Japanese application patent laid-open publication No. 09-22228, the large temperature difference between the upper and lower air flow that is blown onto the recording sheet causes the recording sheet to greatly curl, and many malfunctions occur during the conveyance of the recording sheet on its way to being discharged. Therefore, complicated controls are necessary to make fine adjustments of the air temperature by detecting the outer air temperature, and stopping or operating the second cooling unit.

Furthermore, recording sheet was cooled by the air blown from the fan via an air duct at the air-blowing outlet immediately before the recording sheet is discharged from the apparatus body. Therefore, if the face-down paper discharging operation is conducted, the hot recording sheet which has just passed through the fixing unit comes in contact with conveying rollers and guide plates on the inverting path, causing uneven cooling.

Moreover, in some cases, an image forming apparatus that functions as a recording apparatus is connected to a sheet finisher (also referred to as finisher). The sheet finisher has complicated conveying paths so as to respond to a variety of post-processing procedures, and its conveying speed is faster than that of the image forming apparatus body to reduce the time used for the post-processing procedures. Due to the complicated conveying paths and high-speed conveyance, the conveying roller's conveying power is large, thereby easily causing the image to be contaminated inside the finisher or the paper to be tucked on the finisher's paper discharge tray. Accordingly, when using a finisher, a very high cooling capability is required. However, if the power of blowing air is high, when a finisher is not used, a problem arises in that the ability to stack paper on the paper discharge tray is reduced.

In the light of the above-mentioned problems, an objective of the present invention is to provide a simply-structured, inexpensive image forming apparatus which can form high-quality images by properly cooling the recording sheet that has just passed through the fixing unit, thereby preventing the image roughness, curl, contamination and adhesion of the paper due to the uneven cooling of the recording sheet.

SUMMARY

The objective of the present invention is to solve the above-mentioned subject.

The above objective of the present invention is achieved by the following configuration:

An image forming apparatus comprising:

an image forming unit for transfer a toner image based on image information to a recording material;

a fixing unit for heating and fixing the toner image on the recoding material;

a conveying unit including plural conveying paths for convey the recording material to the image forming unit and discharging the recoding material on which the toner image is formed;

a cooling fan;

an air duct including a first air-blowing outlet and a second air-blowing outlet for conducting air from the cooling fan to an interior of the apparatus; and an air flow changing member for opening or closing the first and second air-blowing outlets;

wherein the recording sheet on the different conveying path is cooled by changing the air flow changing member.

Furthermore, the above objective of the present invention is achieved by the following configuration:

An image forming apparatus comprising:

an image forming unit for transfer a toner image based on image information to a recording material;

a fixing unit for heating and fixing the toner image on the recoding material;

a conveying unit for discharging the recoding material on which the toner image is formed;

a cooling fan for cooling the recording material on which the toner image is formed; and a restrict member for restricting a volume of drawing of air by the cooling fan.

The invention itself, together with further objects and attendant advantages, will best be understood by reference to the following detailed description taken in conjunction with the accompanying drawings.

BRIEF DESCRIPTION OF THE DRAWINGS

In the following description, like parts are designated by like reference numbers throughout the several drawing.

DESCRIPTION OF THE PREFERRED EMBODIMENT

Hereafter, the present invention will be explained in detail with reference to the drawings. However, the present invention is not intended to be limited to the embodiments described below. In all of the drawings, an identical number or symbol is to indicate the same item, and the items will be explained in detail by referring to other relevant drawings as necessary.

Figure 1:
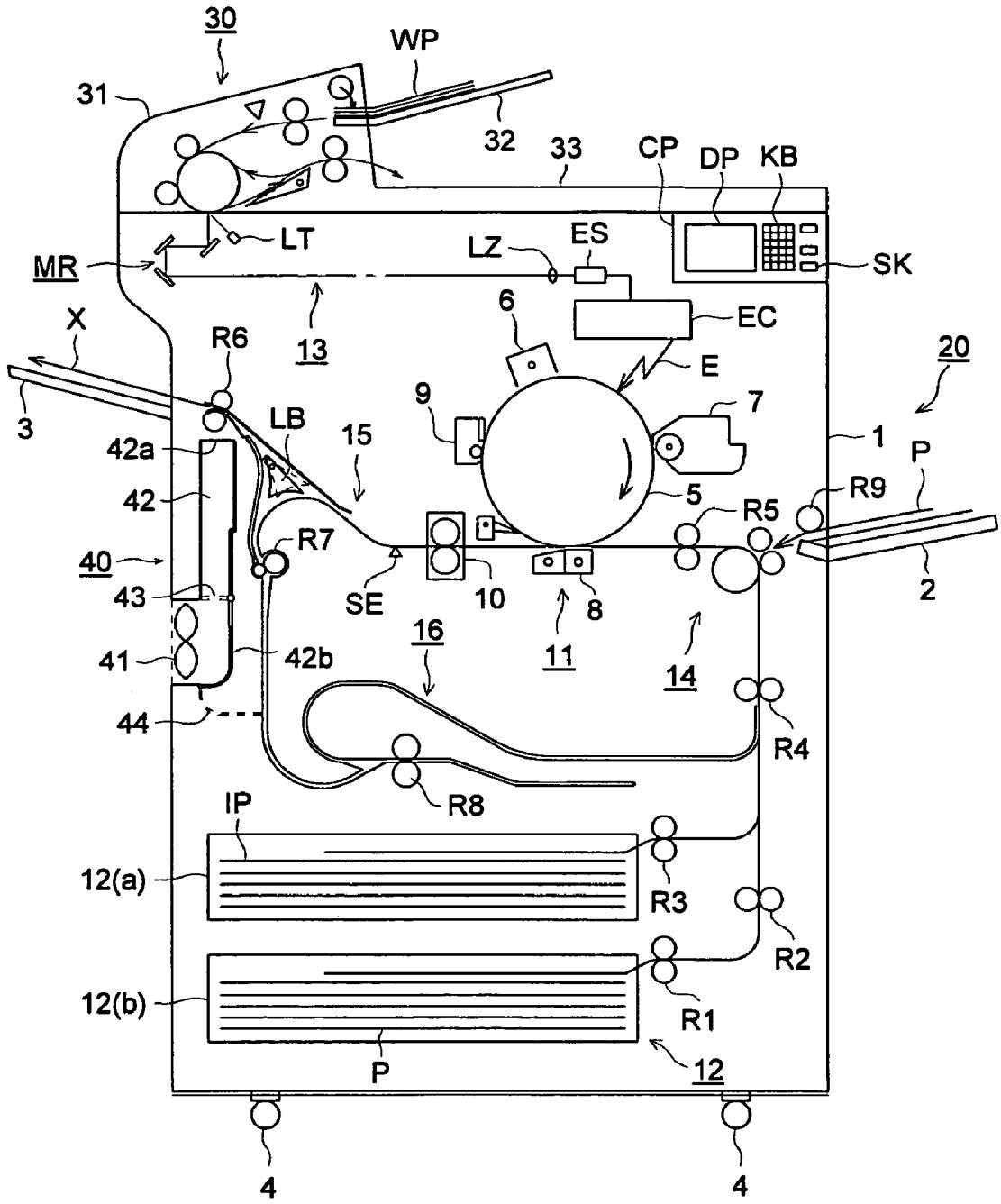
FIG. 1 is a schematic diagram of an image forming apparatus according to the present invention.
Figure 2:
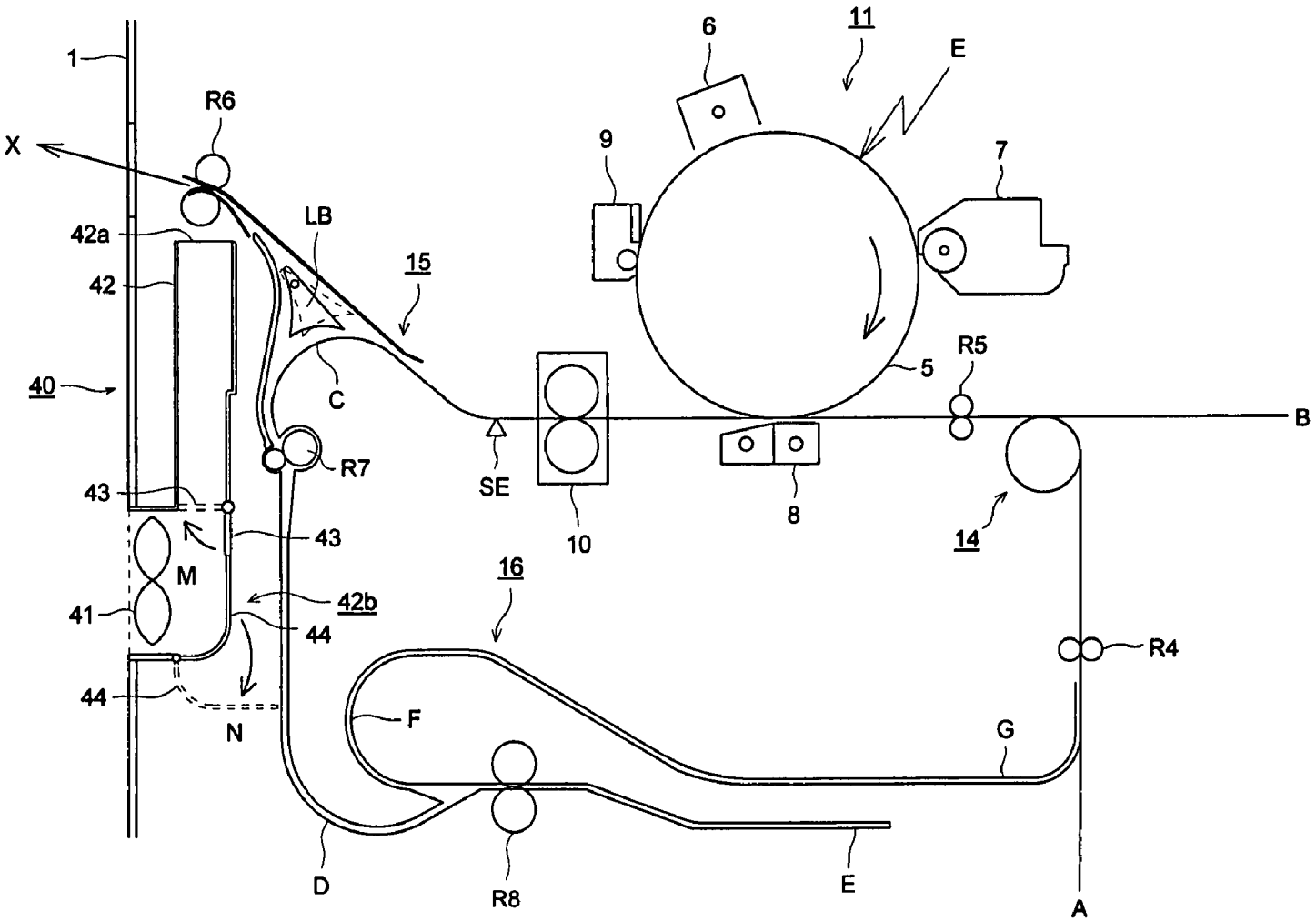
FIG. 2 is a schematic diagram which shows an air supply unit and a conveying path according to the present invention.
Figure 3:
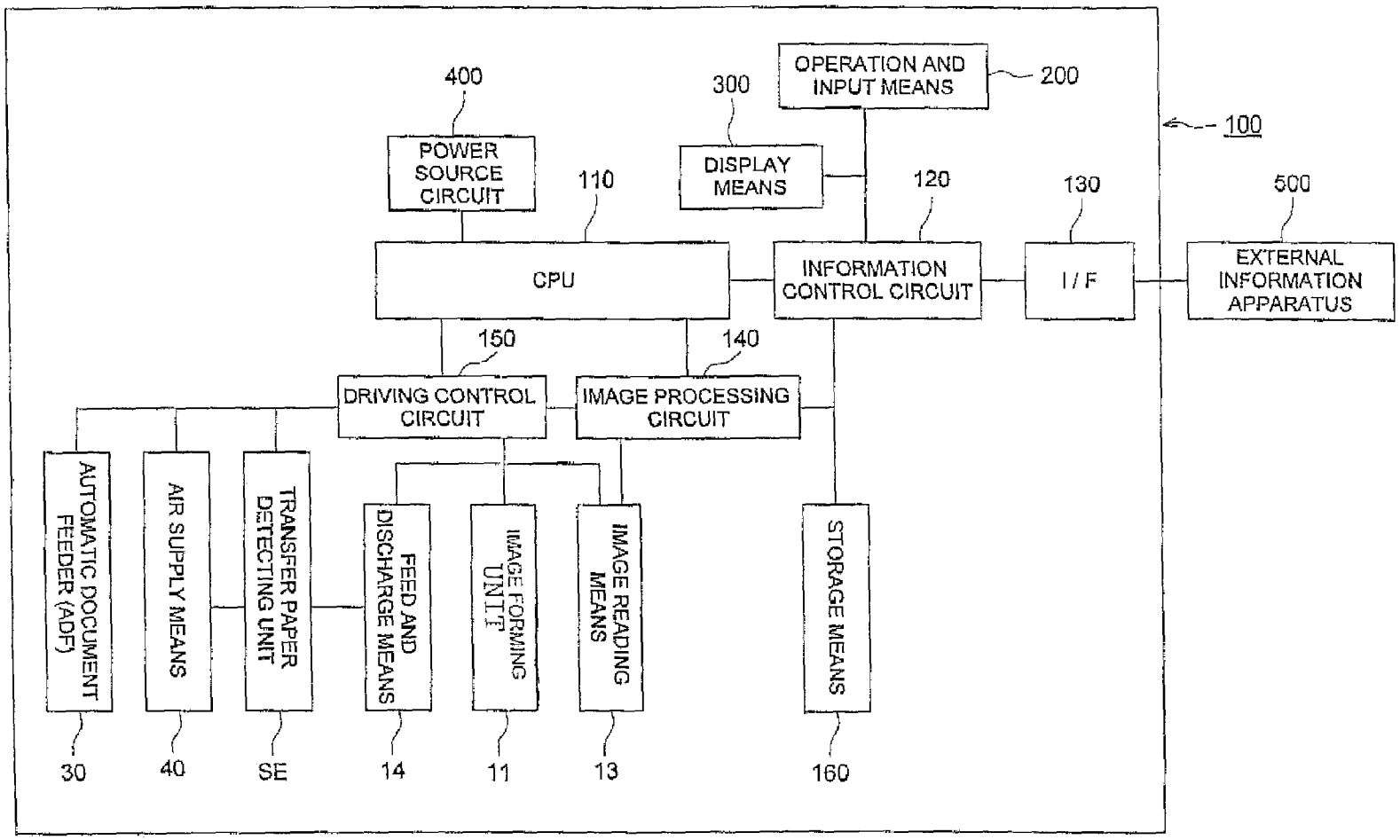
FIG. 3 is a block diagram which shows the circuit configuration of the image forming apparatus according to the present invention.
Figure 4:
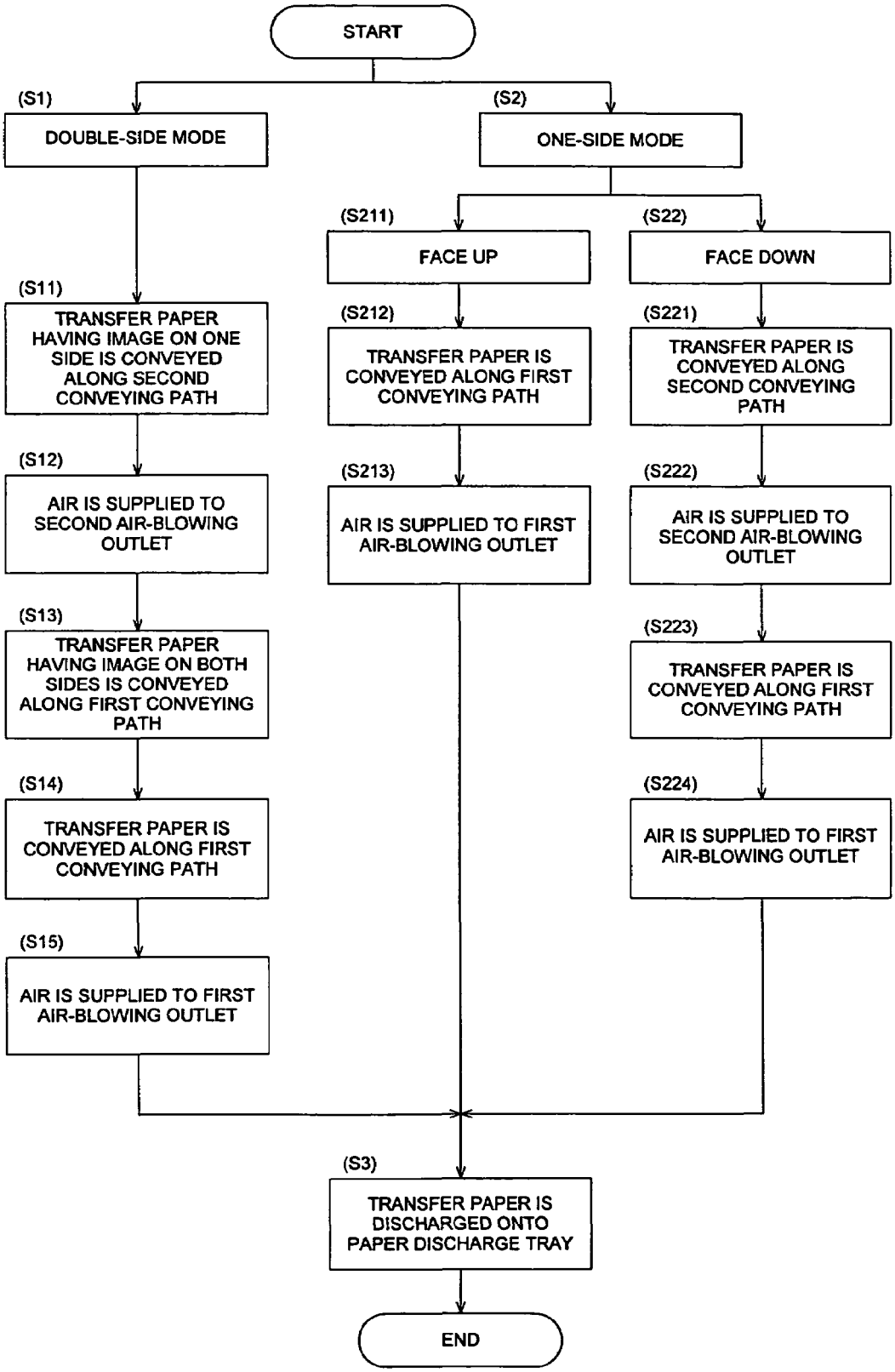
FIG. 4 is a flow chart which shows the control function of the air supply unit according to the present invention.
Figure 5:
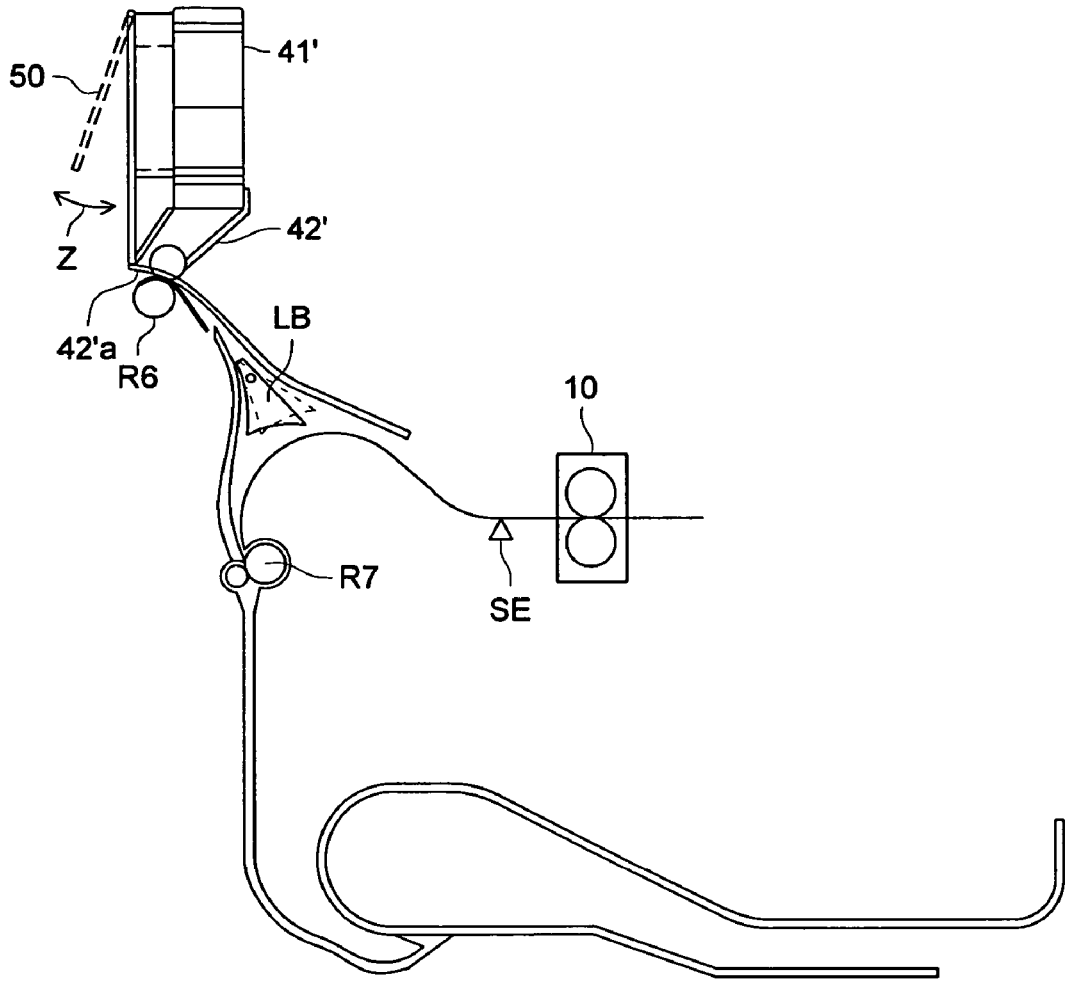
FIG. 5 shows another embodiment of an image forming apparatus according to the present invention.

FIG. 1 is a schematic diagram of an image forming apparatus according to the present invention. FIG. 2 is a schematic diagram which shows an air supply unit and a conveying path according to the present invention. FIG. 3 is a block diagram which shows the circuit configuration of the image forming apparatus according to the present invention. FIG. 4 is a flow chart which shows the control function of the air supply unit according to the present invention. FIG. 5 shows another embodiment of an image forming apparatus according to the present invention.

With reference to FIG. 1, the configuration of the image forming apparatus according to the present invention will be explained below.

To simplify an explanation, an image forming apparatus 20 in this embodiment is assumed to be an electrophotographic copier. Since electrophotographic copiers are well known, portions will be briefly explained.

Reference number 20 denotes an image forming apparatus and 30 denotes an automatic document feeder (ADF) which is attached to the image forming apparatus 20.

The image forming apparatus 20 includes a manual feed tray 2, located on the right side of the chassis 1, for feeding a few sheets of recording sheet (also referred to as transfer sheet or sheet) and a paper discharge tray 3 located on the left side of the chassis 1.

On the paper discharge tray 3, ordinary recording sheet (also referred to as normal paper) P or special recording sheet IP that has been fed by a paper feed cassette 12 (described later) or a manual feed tray 2 and has an image formed thereon is discharged and stacked.

Plural rollers (also referred to as caster) 4 are provided at the bottom of the chassis 1 so that the image forming apparatus 20 can be mobile.

A control panel CP is provided at the upper front of the chassis 1 so as to function as a display unit and operation and input unit for operating the image forming apparatus 20.

The control panel CP incorporates a display unit DP which has been configured by a liquid crystal display unit or a touch-panel type liquid crystal display unit that includes a touch panel in its display unit, and an input unit that functions as an operation and input unit which comprises a keyboard KB for entering numbers and the like, and a start button (also referred to as copy button) SK to execute a series of image forming operations such as copying.

Specifically, in this embodiment, by means of the control panel CP, for example, the one-side printing mode and the double-side printing mode can be selected as printing operation modes and the face-up paper discharging mode and the face-down paper discharging mode can be selected as recording sheet discharging operation modes.

The controller EC, also called a control circuit, is a unit for controlling all of the operations executed by the image forming apparatus 20 and is made up of electric circuits such as CPU and the like. According to the control programs and control data that have been beforehand stored in the CPU, the controller EC controls the drive of all the unit that are included in the image forming apparatus 20.

Furthermore, when an auxiliary device such as an ADF 30 is connected to the image forming apparatus 20, the controller EC operates in the same manner in conjunction with such an auxiliary device, thereby controlling the smooth drive of the entire image forming apparatus 20 as a system.

Moreover, when the image forming apparatus 20 is connected to a personal computer or another information apparatus via a LAN (local area network), the controller EC operates in conjunction with such an apparatus, thereby controlling the smooth drive of the image forming apparatus 20 so that information can be sent, received and stored.

The image forming unit 11 is an apparatus for forming images based on document image information. For example, the image forming unit 11 includes a photosensitive drum (also referred to as photoconductor or image carrier) 5 which rotates in the image-forming direction (for example, clockwise direction indicated by the arrow) preset by the driving source such as a motor; an electrification unit 6 for uniformly electrifying the photosensitive drum 5; an exposure unit, for example, exposure light E that uses a laser beam outputted from a laser output unit including a semiconductor laser so that document image information (also referred to as image data) is converted into a signal thereby forming an electrostatic latent image on the photosensitive drum 5; a developing unit 7 for converting the electrostatic latent image formed on the photosensitive drum 5 into a visible toner image; a transfer and separation unit 8 for transferring the toner image formed on the photosensitive drum 5 onto the recording sheet P; cleaning unit 9 for removing toner residue and paper fibers that remain on the photosensitive drum 5 after the toner image has been transferred on the recording sheet P; and a fixing unit 10 for melting and fixing the transferred toner image onto the recording sheet P.

The image reading unit 13 comprises an optical reading system which includes a light source LT, a mirror group MR, and an image-forming lens LZ, and a reading unit ES which comprises electric circuits including a CCD (solid-state imaging device).

When an image forming apparatus 20 is a copier, the reading unit ES is located at the bottom of the automatic document feeder 30. And information of the image of the document that has been placed on the platen glass (not shown) located at the upper part of the chassis 1 or has been conveyed by the automatic document feeder 30 to the reading position is read by the image reading unit 13, converted into digital image data, and then stored in the storage unit provided in the controller EC.

Specifically, when a document conveyed by the ADF 30 is read by the image reading unit 13, the light source LT illuminates the document conveyed to the reading position, and then an image reflected through an image-forming lens LZ via a mirror group MR is formed on the CCD surface of the reading unit ES, and the image information outputted by the CCD is stored as image data.

The feed and discharge unit 14 is configured as a feed, discharge and conveying unit which comprises a paper feed cassette 12; a recording sheet detecting unit SE which is located in the downstream vicinity of the motor (not shown) of a driving source, plural rollers R1 through R9 and a fixing unit 10 and detects the leading edge or trailing edge of the recording sheet and outputs passage information to control circuit EC; a conveying direction changing member LB located at the conveying direction changing section 15; and an inverting and conveying section 16 which inverts recording sheet when both sides are printed.

The paper feed cassette 12 has, for example, a cassette 12*a* which contains special recording sheet IP such as thick paper and a cassette 12*b* which contains ordinary (normal paper) recording sheet P.

Furthermore, the feed and discharge unit 14 is driven according to the instruction of the controller EC by the control program of the recording sheet conveying mode which corresponds to the recording sheet conveying condition preset by a user via the control panel CP. For example, after the feed and discharge unit 14 has selected either special recording sheet IP or ordinary recording sheet P, it rotates plural groups of rollers by rotating the motor of a driving source, feeds and conveys special recording sheet IP or normal paper P from the paper feed cassette 12 to the photosensitive drum 5 at a proper timing, and then discharges the recording sheet on which image has been formed onto the paper discharge tray 3.

With regard to the recording sheet conveying conditions related to the feed, discharge and conveying unit 14, for example, the one-side printing mode and the double-side printing mode ate available as printing modes, and the face-up paper discharging mode and the face-down paper discharging mode are available as recording sheet discharging and conveying modes. Those modes can be specified by means of the control panel CP as previously mentioned.

On the other hand, the control circuit EC beforehand stores the one-side conveying program which is the recording sheet conveying mode control program, the inverting and conveying program for double side printing, the face-up paper discharging and conveying program, and the face-down paper discharging and conveying program.

Therefore, the control circuit EC selects an appropriate control program of the recording sheet conveying mode which corresponds to the operation mode preset by means of the control panel CP, and controls the drive of the feed, discharge and conveying unit 14 by means of the control program of the selected recording sheet conveying mode.

The conveying unit of the ADF 30 is entirely enclosed in the ADF chassis 31, and the document platen 32 and the paper discharge section 33 are located outside the ADF chassis 31.

On the document platen 32, for example, plural documents WP are placed with the document side (surface) of the first page located at the top. The documents WP are conveyed by the document conveying unit including plural rollers to the reading position, read by the reading unit ES, and then discharged onto the paper discharge section 33.

The document conveying unit is designed to operate in conjunction with the controller EC of the image forming apparatus 20 by means of the driving control circuit (not shown).

An air supply unit 40 according to the present embodiment has a cooling fan 41; an air duct 42 having a first air-blowing outlet 42*a* and a second air-blowing outlet 42*b*; and an air-flow changing member (a) 43 and an air-flow changing member (b) 44 for supplying air by switching between the air-blowing outlet 42*a* and the air-blowing outlet 42*b*.

The cooling fan 41 in this embodiment supplies air taken from outside through the air duct 42, via the first air-blowing outlet 42*a* or the second air-blowing outlet 42*b*, to cool the recording sheet together with the conveying path.

Moreover, the cooling fan 41 starts to operate, for example, when passage information detected by the recording sheet detecting unit SE is inputted into the control circuit EC, and if passage information is not inputted for a prescribed period of time after the fan has started operation, the control circuit EC will stop the operation.

Although details will be described later, the air-flow changing member (a) 43 can be moved to the position indicated by the solid line when it supplies air to the first air-blowing outlet 42*a* that cools the recording sheet immediately before the paper is discharged, and moved to the position indicated by the broken line when the air supply to the first air-blowing outlet 42*a* is blocked.

Furthermore, as described later, the air-flow changing member (b) 44 can be moved to the position indicated by the broken line when cooling the vicinity of rollers R7 at the time the orientation of the printed surface of the recording sheet has been inverted in the changing section 15 to discharge paper face down and also when supplying air to the second air-blowing outlet 42*b* which cools the inverting and conveying section 16 to conduct double-side printing operation. The air-flow changing member (b) 44 can also be moved to the position indicated by the solid line when the air supply to the second air-blowing outlet 42*b* is blocked.

Moreover, the air-flow changing member (a) 43 and the air-flow changing member (b) 44 have a driving mechanism (not shown) that includes a driving source, and their drive is controlled by the control program of the recording sheet conveying mode that corresponds to the operation mode preset by the control circuit EC via the control panel CP.

With reference to FIG. 2, recording sheet's conveying operations will be described. FIG. 2 is a schematic diagram which shows an image forming unit 11 and the recording sheet's conveying path shown in FIG. 1, and the identical number indicates the same item shown in FIG. 1.

When the operation mode is the one-side printing mode, for example, the control circuit EC selects the one-side conveying mode for the feed, discharge and conveying unit 14 and executes the mode. Recording sheet P is fed from the paper feed cassette 12 (path A) or the manual feed tray 2 (path B) to the image forming unit 11, and image is printed on one side of the recording sheet P by means of the image forming unit 11, and then the paper is conveyed to the conveying direction changing section 15.

At this point, if the operation mode is the face-up paper discharging mode, when the recording sheet P has passed the fixing unit 10 and the recording sheet detecting unit SE detects the trailing edge of the recording sheet P, passage information is inputted into the control circuit EC thereby executing the face-up paper discharging and conveying mode. And then the feed, discharge and conveying unit 14 holds the conveying direction changing member LB located in the changing section 15 in the position indicated by the solid line.

Therefore, recording sheet P is conveyed from the fixing unit 10 to the path of rollers R6 (first conveying and discharging path), and then subsequently conveyed via the recording sheet discharging path while recording sheet P is being supported between a pair of rollers R6 by the drive of the rollers R6, and is finally discharged onto the paper discharge tray 3. At this point, recording sheet P is located with the printed surface face up.

Furthermore, in cases when the operation mode is the face-down paper discharging mode, when the recording sheet detecting unit SE detects the trailing edge of the recording sheet P, passage information is inputted into the control circuit EC thereby executing the face-down paper discharging and conveying mode. And the feed, discharge and conveying unit 14 moves the conveying direction changing member LB located in the changing section 15 to the position indicated by the broken line.

Therefore, the direction in which recording sheet P is conveyed is changed to the direction of the rollers R7 by the conveying direction changing member LB, and the paper is conveyed via path C (second conveying and discharging path). Moreover, the recording sheet P is conveyed while it is supported between a pair of rollers R7, until, for example, the rollers R7 stop driving when the prescribed period of time has passed after the recording sheet detecting unit SE detected the trailing edge of the recording sheet P. When the rollers R7 stop driving, the recording sheet P stops moving with its trailing edge supported between a pair of rollers R7.

Next, the control circuit EC returns to the conveying direction changing member LB to the initial position indicated by the solid line, and rotates rollers R7 in the reverse direction. Because the reverse rotation of the rollers R7 allows recording sheet P to be conveyed directly along the path oriented from rollers R7 to rollers R6 without passing along path C, the printed surface of the recording sheet P is inverted.

Subsequently, due to the drive of the rollers R6, recording sheet P is conveyed along the recording sheet discharging path while it is supported between a pair of rollers R6, and discharged onto the paper discharge tray 3. At this point, the recording sheet P is located with the printed surface face down.

When the operation mode is the double-side printing mode, the control circuit EC selects the inverting and conveying mode for the feed, discharge and conveying unit 14 to execute the double side printing operation. The one-side printing procedures are the same as those of the one-side printing mode. First, one side of recording sheet P is printed.

Next, when one side printing has been finished, recording sheet P is conveyed from the fixing unit 10 of the image forming unit 11 to the conveying direction changing section 15. At this point, the recording sheet detecting unit SE detects the trailing edge of the recording sheet P, and the control circuit EC moves the conveying direction changing member LB to the position indicated by the broken line.

Therefore, the direction to which recording sheet P is conveyed is changed toward the rollers R7 by the conveying direction changing member LB and conveyed via path C. Moreover, recording sheet P is conveyed via path D while it is supported between a pair of rollers R7, and then enters the inverting and conveying path 16 to conduct double side printing.

When the recording sheet P has entered the inverting and conveying path 16, the recording sheet P is supported between a pair of rollers R8, and its leading edge is conveyed to the direction indicated by E by means of the rotation of the rollers R8 and then stops. Subsequently, the rollers R8 rotate in the reverse direction, and the recording sheet P is conveyed via path F and path G, and now recording sheet P's previous trailing edge becomes its leading edge, and the printed surface of the recording sheet P is inverted. Then, the recording sheet P is conveyed again by a pair of rollers 4 and 5 toward the image forming unit 11.

Furthermore, when discharging the recording sheet P, which has images on both sides, with the previously printed surface face down, the previously mentioned face-up paper discharging mode is executed because the previously printed surface has already been face down at the time the recording sheet P passed the fixing unit 10 the second time. When discharging the recording sheet P with the previously printed surface face up, the recording sheet is inverted inside out and the previously mentioned face-down paper discharging mode is executed.

Next, the cooling operation conducted by the air supply unit 40 according to the present invention will be explained.

In this embodiment, the cooling operation by the air supply unit 40 is executed in conjunction with the recording sheet feed mode. That is, when the control circuit EC is executing either of the recording sheet conveying modes and when the recording sheet detecting unit SE detects the trailing edge of the recording sheet P and outputs passage information and the passage information is inputted into the control circuit EC, the cooling fan 41 of the air supply unit 40 starts to operate. The air-flow changing member (a) 43 or the air-flow changing member (b) 44 also operates so that air is supplied to the first air-blowing outlet 42*a* for cooling the recording sheet immediately before it is discharged. Or air is supplied to the second air-blowing outlet 42*b* so as to cool the vicinity of the rollers R7 when the orientation of the printed surface of the recording sheet has been inverted in the changing section 15 to discharge paper face down, and also to cool the inverting and conveying section 16 when conducting double side printing.

Hereafter, an explanation will be given with reference to the flow chart shown in FIG. 4.

(B) In the face-down paper discharging and conveying mode, that is, when the operation mode is the one-side printing mode (S2) and the face-down paper discharging mode (S22) has been set, recording sheet P is conveyed to the second conveying path (S221) after it has passed the fixing unit 10. In the same manner as case (A), when the recording sheet detecting unit SE detects the trailing edge of the recording sheet P and passage information is inputted into the control circuit EC, the control circuit EC moves the conveying direction changing member LB located in the conveying direction changing section 15 to the position indicated by the broken line so as to convey recording sheet P along the path C. Simultaneously, the control circuit EC rotates the cooling fan 41 and moves the air-flow changing member (a) 43 to the position indicated by the broken line shown in FIG. 2, as arrow M shows and moves the air-flow changing member (b) 44 to the position indicated by the broken line shown in FIG. 2, as arrow N shows, so as to block the air supply to the first air-blowing outlet 42*a*. When recording sheet P is conveyed along the path which extends from the rollers R7 toward direction D, the second air-blowing outlet 42*b* cools the vicinity of the rollers R7 so as to cool the recording sheet P (S222).

Next, the rollers R7 are rotated in the reverse direction to convey the recording sheet P along the first conveying path (S223). At this point, the air-flow changing members (a) 43 and (b) 44 are returned to the position indicated by the solid line, and then air is supplied from the first air-blowing outlet 42*a* to cool the recording sheet P (S224).

That is, since FIG. 2 is a schematic diagram in which rollers and conveying guides located along the conveying path are omitted, there are actually many rollers and conveying guides. In the face-down paper discharging mode, the printed surface of the recording sheet P is located face down, and therefore, recording sheet comes in contact with many rollers and guides while it is being conveyed. Accordingly, if toner on the printed surface has not been firmly fixed, the paper surface may have more image roughness or may be further contaminated due to uneven cooling when compared to the face-up paper discharging mode. Therefore, in the face-down paper discharging mode, it is necessary for the recording sheet to cool quicker than in the face-up paper discharging mode.

(C) In the double side conveying mode, that is, when the operation mode is the double side mode (S1), in the same manner as case (B), when the recording sheet detecting unit SE detects the trailing edge of the recording sheet P and passage information is inputted into the control circuit EC, the control circuit EC moves the conveying direction changing member LB located in the conveying direction changing section 15 to the position indicated by the broken line, and conveys the recording sheet P along path C which configures the second conveying path (S11).

Simultaneously, the control circuit EC rotates the cooling fan 41 and moves the air-flow changing member (a) 43 to the position indicated by the broken line in FIG. 2, as arrow M shows, and also moves the air-flow changing member (b) 44 to the position indicated by the broken line in FIG. 2, as arrow N shows, so as to block the air supply to the first air-blowing outlet 42*a*. Then, when the recording sheet P is conveyed along the path which extends from the rollers R7 toward direction D, air from the second air-blowing outlet 42*b* cools the vicinity of the rollers R7. Furthermore, when printing is conducted on both sides, the inverting and conveying section 16 for inverting the recording sheet is cooled to cool the recording sheet P (S12).

That is, the path along which recording sheet is conveyed when double side printing is conducted is longer than the path along which face-down paper is discharged as shown in case (B), and the recording sheet printed on both sides comes in contact with more rollers and conveying guides than the face-down paper. Therefore, it is necessary for the recording sheet which is printed on both sides to quickly and uniformly cool.

Furthermore, after both sides have been printed (S13), the recording sheet P is conveyed along the first conveying path (S14). And then the cooling fan 41 rotates to supply air from the first air-blowing outlet 42*a* (S15) thereby cooling the recording sheet P immediately before the paper is discharged. And then the paper is discharged onto the paper discharge tray 3 (S3).

When recording sheet P is discharged with its printed surface face down, because the printed surface has already been face down at the time the paper passed the fixing unit 10 the second time, the face-up paper discharging mode is executed and the cooling process is conducted as shown in case (A).

Furthermore, when both sides have been printed and recording sheet P is discharged with its previously printed surface face down, because the previously printed surface has already been face down at the time the paper passed the fixing unit 10 the second time, the face-up discharging mode is executed and the cooling process is conducted as shown in case (A). When the recording sheet P is discharged with its previously printed surface face up, the face-down paper discharging mode is executed and to invert the recording sheet P inside out and the cooling process as shown in chassis (B) is conducted.

As stated above, in this embodiment, the control circuit EC operates the cooling fan 41 of the air supply unit 40 according to the passage information outputted by the recording sheet detecting unit SE, and also operates the air-flow changing member (a) 43 and the air-flow changing member (b) 44 according to the recording sheet conveying mode. Thereby quickly solidifying and fixing toner on the recording sheet that has passed the fixing unit 10. As a result, it is possible to prevent image roughness, curl, contamination and adhesion of the paper surface that have occurred due to the uneven cooling of the recording sheet.

Herein, the circuit configuration of the image forming apparatus in this embodiment will be briefly explained by referring to FIG. 3.

Reference number 100 shows the configuration of various unit and circuits of the image forming apparatus 20, 110 denotes the CPU that controls the entire image forming apparatus and has stored various programs for controlling the image forming apparatus 20 and data required for executing the programs.

The CPU 110 is connected to an information control circuit 120, an image processing circuit 140, a driving control circuit 150 and a power source circuit 400. And those circuits constitute a controller EC shown in FIG. 1 thereby controlling the entire image forming apparatus 20.

The information control circuit 120 is connected to an external information apparatus 500 via an interface (I/F) 130 according to the instructions by the CPU 110. And image information, such as text and images, and preset information necessary for forming images, such as density and magnification, are inputted as JOB information for each JOB as a printing unit and stored in the storage unit 160. Then, preset information stored in the storage unit 160 is outputted to the image processing circuit 140, driving control circuit 150, or display unit 300.

Furthermore, in addition to the JOB information, including image information and preset information, that has been inputted from the external information apparatus 500, the information control circuit 120 has a function to convey instructions necessary for operating various circuits and unit that include the image processing circuit 140 and the driving control circuit 150. For example, it conveys various kinds of information inputted by the operation and input unit 200 to the circuits and means of the image forming apparatus so as to smoothly and properly operate the image forming apparatus.

Moreover, the external information apparatus 500 is mainly a computer or an Internet server, however, in some cases, it could be another image forming apparatus on the local area network (LAN) or an information apparatus such as a digital camera and a measuring apparatus that can output the measured information.

The interface (I/F) 130 is an information sending and receiving unit, and is configured such that it can be connected to the previously mentioned computer, another image forming apparatus, and an external information apparatus 500 including an Internet server via a variety of networks.

The operation and input unit 200 is an input unit located on the control panel CP of the image forming apparatus 20. It could be a liquid crystal display unit DP including a previously mentioned touch panel, keyboard KB, and a start button SK.

For example, by operating the keyboard KB, it is possible to enter settings, such as the number of recording materials (also referred to as recording sheet) to be outputted, type of paper (for example, index sheet, thick paper, normal paper, thin paper, recycled paper, OHP sheet, etc.), magnification (enlargement or reduction), or the density of the output image.

Furthermore, in some cases, the operation and input unit 200 also functions as an input unit for setting various operation modes of the image forming apparatus 20.

Specifically, in the embodiment of the present invention, as described in detail later, the operation modes that can be specified by operating the control panel CP of the operation and input unit 200 include, for example, the one-side printing mode and the double-side printing mode for the printing process, and the face-up paper discharging mode and the face-down paper discharging mode for the recording sheet conveying and discharging process.

Therefore, in the control circuit EC of the image forming apparatus 20, for the CPU 110, to control the drive of the feed and discharge unit 14 in the preset operation mode, control programs of various recording sheet conveying modes that have been preset according to the previously mentioned various operation modes, for example, the one-side conveying program, inverting and conveying program for double side printing, face-up paper discharging and conveying program, and face-down paper discharging and conveying program, have been stored in the storage unit 160.

The display unit 300 is a previously mentioned liquid crystal display unit or a display unit DP which incorporates a touch panel on the liquid crystal display section.

The display unit 300 displays operation procedures for entering information by means of the operation and input unit 200 and the lists of various information, or displays information stored in the storage unit 160, or displays conditions and warning messages when the image forming apparatus 20 is in operation.

According to the instructions of the CPU 110, the image processing circuit 140 converts image information of the document that has been read by the image reading unit 13 into digital data and stores the data as image data in the storage unit 160, and converts the image data stored in the storage unit 160 into data and signals that correspond to the image forming method of the image forming unit 11 when the image forming unit 11 forms images.

According to the instructions of the CPU 110, the driving control circuit 150 operates the image forming unit 11, image reading unit 13, feed and discharge unit 14, and the ADF 30 at the best timing according to the preset operation mode, thereby conducting an image forming operation.

Moreover, an image forming apparatus 20 of this embodiment includes a recording sheet detecting unit SE and an air supply unit 40. According to the operation mode that has been preset by means of the operation and input unit 200 and instructions by the CPU 110, the driving control circuit 150 executes the recording sheet conveying mode control program and simultaneously inputs recording sheet passage information sent by the recording sheet defecting unit SE. And then the driving control circuit 150 controls the drive of the cooling fan 41 of the air supply unit 40, an air-flow changing member (a) 43, or an air-flow changing member (b) 44, thereby quickly solidifying and fixing toner on the recording sheet. As a result, it is possible to prevent image roughness, curl, contamination and adhesion of the paper due top the uneven cooling of the recording sheet, thereby forming high qualify images.

The storage unit 160 stores JOB information and JOB data, such as image data necessary for forming images, preset conditions for controlling the image forming apparatus 20, and information about various operation mode programs.

Moreover, JOB information is information about an individual job (JOB). For example, when the image forming apparatus 20 is a copier, JOB information includes the document setting according to document image information, selection of either the one-side mode or double-side mode, selection of the paper feed tray, selection of the number of copies, and selection of printing density. That is, JOB information is a series of print data inputted to make various settings and instruct the copy operation to begin. A print data group that corresponds to such one piece of printing instruction (also referred to as one printing unit) is called one JOB.

Furthermore, in the same manner, when image forming apparatus is a printer, a series of print data groups sent by the external information apparatus 500 is called JOB information, and a print data group that corresponds to one piece of printing instruction is called one JOB. And, handling JOB information and JOB data for each JOB is called one JOB unit.

Moreover, JOB data unit detailed data that accompanies JOB information and is related to control items for executing image forming operations, for example, conveying speed according to the recording material.

Therefore, the storage unit 160 stores JOB information and JOB data for each JOB, that is, for one JOB unit (simply, referred to as JOB unit).

The image forming unit 11 comprises, as shown in FIG. 1, a photosensitive drum 5, an electrification unit 6, a developing unit 7, a transfer and separation unit 8, a cleaning unit 9, and a fixing unit 10, and is operated by the driving control circuit 150.

Then, based on the image data that has been read by the image reading unit 13 and stored by the storage unit 160 and by means of control by JOB information and JOB data, a toner image is formed on the photosensitive drum 5, and the toner image is transferred onto a recording material, such as ordinary recording sheet (normal paper) P or special recording sheet IP, and then melts and fixes thereby being recorded on the recording material.

The image reading unit 13 has, as shown in FIG. 1, an optical reading system and a reading unit ES, and is operated by the driving control circuit 150. Image information of the document that has been conveyed to the reading position is read by the reading unit ES, and the read image information is, for example, converted into digital image data by the image processing circuit 140, and then stored in the storage unit 160.

As shown in FIG. 1, the feed and discharge unit 14 is configured as a feed, discharge, and conveying unit which has a paper feed cassette 12 containing special recording sheet IP or ordinary recording sheet (normal paper) P and a conveying mechanism which includes driving sources (not shown) such as plural rollers and a motor.

The feed, discharge and conveying unit, as a feed and discharge unit 14, is operated according to the instructions of the CPU 110 via a driving control circuit 150, and conveys recording sheet IP or recording sheet P selectively fed from the paper feed cassette, 12 to the photosensitive drum 5 at a proper timing, and then discharges, onto the paper discharge tray 3, the recording sheet IP or recording sheet P on which images have been formed after passing through the one-side printing or double-side printing process.

Specifically, in this embodiment, according to the one-side printing mode, double-side printing mode, face-up paper discharging mode, or the face-down paper discharging mode that has been set by means of the control panel CP of the operation and input unit 200, the CPU 110 reads any one of the one-side conveying program, inverting and conveying program for double-side printing, face-up paper discharging and conveying program, and face-down paper discharging and conveying program from the storage unit 160 via the information control circuit 120, and then according to the selected program, the CPU 110 operates the feed and discharge unit 14 via the driving control circuit 150, thereby conveying recording sheet according to the selected mode.

The recording sheet detecting unit SE, which has, for example, a photo coupler and a mechanical switch, is installed along the conveying path in the vicinity of the fixing unit 10, and outputs passage information to the driving control circuit 150 when it has detected the trailing edge of the recording sheet.

Moreover, in this embodiment, the trailing edge of the recording sheet is detected, but it is possible to design this embodiment so that the leading edge of the recording sheet can be detected. For example, in cases when the fixing unit 10 is located near the conveying direction changing section 15, an alternative design is obviously possible that allows for sufficient operation timing to switch the conveying direction changing member LB by detecting the leading edge of the recording sheet.

The air supply unit 40 has a cooling fan 41 and a driving source (not shown) for driving an air-flow changing member (a) 43 and an air-flow changing member (b) 44.

In this embodiment, the CPU 110 operates the air supply unit 40 via the driving control circuit 150 thereby cooling recording sheet. Specifically, the driving control circuit 150 operates and stops the cooling fan 41 according to the recording sheet conveying mode and the passage information sent by the recording sheet detecting unit SE. The driving control circuit 150 also operates the air-flow changing member (a) 43 and the air-flow changing member (b) 44 by controlling the drive source so as to cool the vicinity of the rollers R7 or cool the inverting and conveying section 16 when the face-up paper discharging mode, face-down paper discharging mode, or double-side mode is selected. By combining those operations, the driving control circuit 150 efficiently cools the conveying path along which recording sheet passes at the right timing.

Moreover, plural air-flow changing member (43, 44) are provided that correspond to the first air-blowing outlet 42*a* and the second air-blowing outlet 42*b* respectively. Furthermore, in this embodiment, the second air-blowing outlet 42*b* has two members (43, 44) and therefore, space for switching the air-blowing outlets is reduced.

As shown in FIG. 1, the automatic document feeder (ADF) 30 automatically conveys documents placed on the document platen 32 one by one by means of the document conveying unit to the reading position. It operates in conjunction with the driving control circuit 150 according to the instructions of the CPU 110 of the image forming apparatus 20.

When the power switch (not shown) is turned on by a user, the power source circuit 400 properly supplies electricity from the power source to the entire image forming apparatus, and when the power switch is turned off, it stops the supply of electricity.

Moreover, even when the power switch is turned on, for example, if the energy saving mode has been selected to set the image forming apparatus in the standby mode, the CPU 110 instructs to keep supplying only electricity necessary for temporarily storing memory contents, and blocks the supply of electricity to the fixing unit's heater and the like.

As stated above, the cooling operation of the air supply unit 40 in this embodiment has been explained. The present invention quickly cools recording sheet that has passed the fixing unit so that toner is quickly solidified and fixed. By cooling the conveying path along which recording sheet passes according to the recording sheet conveying mode at the timing for which the recording sheet passes, it is possible to prevent image roughness, curl, contamination and adhesion of the paper due to the uneven cooling of recording sheet. As a result, it is possible to efficiently cool recording sheet while minimizing the use of electricity.

Accordingly, if the recording sheet conveying mode, conveying path, and the timing for conveying recording sheet are different, it is desirable to conduct cooling operation according to the different recording sheet conveying mode. And therefore, the direction and the number of air-blowing outlets, the number of air-flow changing member, and the timing for open and close operations are not intended to be limited to those of this embodiment.

Hereafter, another embodiment will be explained with reference to FIG. 5.

Another embodiment includes a fixing section 10, a cooling fan (also referred to as sirocco fan) 41' located at the upper part of the discharge section, an air duct 42', and an air supply restricting member 50 which controls the amount of air supplied by the cooling fan 41'. Recording sheet on which an image has been fixed by the fixing section 10 passes the lower part of the air duct 42'a and is discharged.

In the above configuration, a restricting plate that functions as an air supply restricting member 50 is provided on the air supply outlet of the cooling fan 41'. For example, by opening and closing the air supply restricting member 50 in the direction of arrow Z, it is possible to enhance the ability of the cooling fan 41' thereby efficiently cooling recording sheet before it is discharged.

The air volume can be changed by the air supply restricting member 50, for example, according to the presence or absence of the sheet finisher (not shown) that is connected to the rear stage (left side in the drawing) of the image forming apparatus body. A sensor (not shown) detects whether the sheet finisher is connected or not, and when the sheet finisher is detected, the air supply restricting member 50 is opened to cool recording sheet to maximum capability. And when the sheet finisher is not detected, the amount of air supply is reduced by closing the air supply restricting member 50.

In another embodiment, it is recommended that an air supply restricting member 50 be installed when the sheet finisher is not connected, and the air supply restricting member 50 be removed when the sheet finisher is connected. Furthermore, to control the amount of air supply, it is recommended that the air supply restricting member 50 be able to slide over the image forming apparatus body, and the area of the opening for taking in air from the cooling fan can be changed.

The present invention operates an air flow changing member according to the recording sheet conveying mode, thereby controlling the air supply from the cooling fan via the first air-blowing outlet or the second air-blowing outlet. As a result, it is possible to provide a simply-structured, inexpensive image forming apparatus which can properly supply air according to the recording sheet conveying mode and can prevent image roughness, curl, contamination and adhesion of the paper due to the uneven cooling of the recording sheet, thereby forming high quality images.

Specifically, the above-mentioned image forming apparatus controls the cooling fan according to the passage information detected by the recording sheet detecting unit, and therefore, it is possible to conduct efficient cooling operation without excessively cooling the inside of the apparatus by continuously operating the cooling fan causing defective fixation and also causing electricity to be wasted, thereby forming high quality images.

Furthermore, it is possible to provide an image forming apparatus that forms high quality images in any recording sheet conveying mode because recording sheet is properly cooled according to the recording sheet conveying mode by properly supplying air from the air-blowing outlet oriented toward the corresponding conveying path in the face-up paper discharging mode, face-down paper discharging mode, or double side printing mode.

Moreover, in this embodiment, a copier has been explained as an image forming apparatus, however, the image forming apparatus can also be a printer or a facsimile as far as the image forming apparatus forms images by using an electrophotographic toner.

According to the present invention, the following effects can be obtained:

It is possible to provide a simply-structured, inexpensive image forming apparatus which can properly supply air according to the recording sheet conveying mode and can prevent image roughness, curl, contamination and adhesion of the paper due to the uneven cooling of the recording sheet, thereby forming high quality images because the image forming apparatus operates an air flow changing member according to the recording sheet conveying mode, thereby controlling the air supply from the cooling fan via the first air-blowing outlet or the second air-blowing outlet.

Specifically, the image forming apparatus according to the present invention controls the cooling fan according to the passage information detected by the recording sheet detecting unit, and therefore, it is possible to conduct efficient cooling operation without excessively cooling the inside of the apparatus by continuously operating the cooling fan causing defective fixation and also causing electricity to be wasted, thereby forming high quality images.

Furthermore, it is possible to provide an image forming apparatus that forms high quality images in any recording sheet conveying mode because recording sheet is properly cooled according to the recording sheet conveying mode by properly supplying air from the air-blowing outlet oriented toward the corresponding conveying path in the face-up paper discharging mode, face-down paper discharging mode, or double side printing mode.

Moreover, because the air volume of the cooling fan can be restricted, it is possible to form high-quality images by using the cooling fan having powerful cooling capability regardless of the presence or absence of the sheet finisher.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming apparatus comprising:

an image forming unit for transferring a toner image based on image information to a recording material;

a fixing unit for heating and fixing the toner image on the recording material;

a conveying unit including a plurality of conveying paths for conveying the recording material to the image forming unit and discharging the recording material on which the toner image is formed;

a controller for controlling the plurality of conveying paths so that the recording material is conveyed by one or more of the plurality of conveying paths according to a recording material conveying mode;

a cooling fan;

an air duct including a first air-blowing outlet and a second air-blowing outlet for conducting air from the cooling fan to an interior of the apparatus; and an air flow changing member for opening or closing the first and second air-blowing outlets;

wherein the controller controls the air flow changing member according to the recording material conveying mode for cooling the recording material.

2. The image forming apparatus according to claim 1, wherein said plurality of conveying paths comprises:

a first conveying and discharging path for conveying and discharging the recording material from said fixing unit to a paper discharge tray;

a second conveying and discharging path for inverting and discharging the recording material from said fixing unit to a paper discharge tray; and an inverting and conveying path for inverting and conveying the recording material from said fixing unit to said image forming unit.

3. The image forming apparatus according to claim 1, wherein said air flow changing member comprises a first air flow member for said first air-blowing outlet and a second air flow member for said second air-blowing outlet.

4. An image forming apparatus comprising:

an image forming unit for transferring a toner image based on image information to a recording material;

a fixing unit for heating and fixing the toner image on the recording material;

a conveying unit including a plurality of conveying paths for conveying the recording material to the image forming unit and discharging the recording material on which the toner image is formed;

a cooling fan;

an air duct including a first air-blowing outlet and a second air-blowing outlet for conducting air from the cooling fan to an interior of the apparatus; and an air flow changing member for opening or closing the first and second air-blowing outlets;

wherein the recording material on different conveying paths is cooled by changing the air flow changing member.

5. The image forming apparatus according to claim 4, further comprising a controller which controls the conveying unit according to a plurality of preset recording material conveying modes so that the recording material is conveyed along any one of the plurality of conveying paths of said conveying unit, and a recording material detecting unit which detects that recording material has passed said fixing unit and outputs passage information, said controller controlling the start of operation of said cooling fan according to said passage information outputted by said recording material detecting unit.

6. The image forming apparatus according to claim 5, wherein said plurality of conveying paths include a first conveying and discharging path for conveying and discharging the recording material from said fixing unit to a paper discharge tray;

a second conveying and discharging path for inverting and discharging the recording material from said fixing unit to a paper discharge tray; and an inverting and conveying path for inverting and conveying the recording material from said fixing unit to said image forming unit.

7. The image forming apparatus according to claim 6, wherein said controller operates said air flow changing member so that, when said recording material conveying mode is in face-up recording material discharging mode for discharging recording material via said first conveying and discharging path air is supplied to said first air-blowing outlet for cooling the recording material;

when said recording material conveying mode is in face-down recording material discharging mode for discharging recording material via said second conveying and discharging path, air is supplied from said second air-blowing outlet for cooling the recording material and then air is supplied from said first air-blowing outlet for cooling the recording material; and when said recording material conveying mode is in double-side printing mode for discharging recording material via said inverting and conveying path, air is supplied from said second air-blowing outlet for cooling the recording material which has an image formed on one side, and then air is supplied from said first air-blowing outlet for cooling the recording material which has images formed on both sides of the recording material.

8. The image forming apparatus according to claim 4, wherein said air flow changing member comprises a first air flow changing member for opening or closing said first air-blowing outlet and a second air flow changing member for opening or closing said second air-blowing outlet.

* * * * *